United States Patent [19]

Schmid

[11] Patent Number: 4,686,839

[45] Date of Patent: Aug. 18, 1987

[54] FLAT KNITTING MACHINE WITH NEEDLE SELECTION DEVICE

[75] Inventor: Franz Schmid, Bodelshausen, Fed. Rep. of Germany

[73] Assignee: H. Stoll GmbH & Co., Fed. Rep. of Germany

[21] Appl. No.: 931,790

[22] Filed: Nov. 18, 1986

[30] Foreign Application Priority Data

Nov. 21, 1985 [DE] Fed. Rep. of Germany ..... 3541171

[51] Int. Cl.[4] ..... D04B 7/00; D04B 15/66

[52] U.S. Cl. ..... 66/75.2

[58] Field of Search ..... 66/75.2, 75.1

[56] References Cited

U.S. PATENT DOCUMENTS 3,699,782 10/1972 Hadam ..... 66/75.1
3,892,108 7/1975 Hadam ..... 66/75.2
4,481,793 11/1984 Cuche et al. ..... 66/75.2
4,554,802 11/1985 Goller et al. ..... 66/75.2
4,554,803 11/1985 Schmodde et al. ..... 66/75.2
4,584,850 4/1986 Haltenhof ..... 66/75.1
4,615,187 10/1986 Schimko ..... 66/75.2

*Primary Examiner*—Ronald Feldbaum
*Attorney, Agent, or Firm*—Larson and Taylor

[57] ABSTRACT

In the flat knitting machine with a needle selection device, the needles (12) are selected at double selection points and the non-selected needles (12) are locked by means of a locking jack (25) and the control butt (22) of their needle jack (19) is removed from the cam tracks. Force is transmitted to the needle (12) at a special coupling position (23/24) from the control butt (22) of the needle jack (19) articulated to the needle (12), and to increase the control possibilities without provision of additional cam tracks, presser cam elements (57–59), which act on the depressor butts (26) of the locking jacks (25) can be displaced in the plane of the cams. (FIG. 1).

14 Claims, 8 Drawing Figures

FLAT KNITTING MACHINE WITH NEEDLE SELECTION DEVICE

Figure 1:
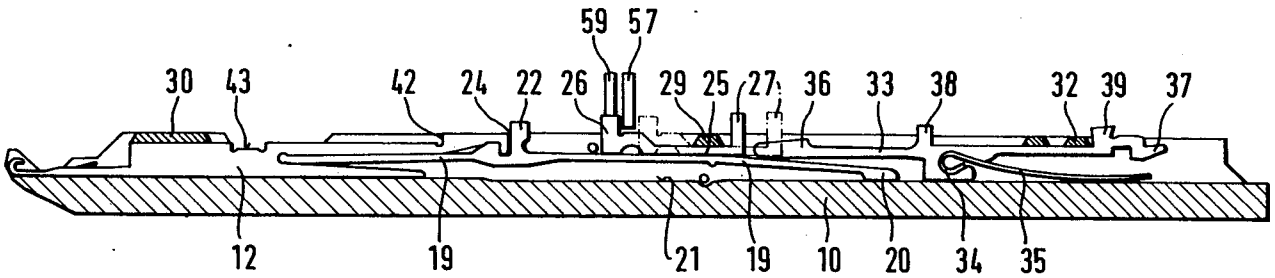

The invention relates to a flat knitting machine with a needle selection device, having two needle beds provided with tricks for guiding needles, needle jacks, and selection jacks and a cam carriage with combined knitting and loop transfer systems, which have adjustable presser cam elements for a depressor jack associated with each needle, adjustable lowering cam elements and needle jacks which are articulated with the longitudinally moveable needles and have a control butt, which can be sunk into the needle bed and thus removed from the cam tracks of the cam carriage.

Flat knitting machines of the kind set out in the introduction have already been proposed by the applicant or are known, for example, from West German patent specification (DE - OS) No. 3315283. Basically, it is sought here to achieve as varied as possible, a control of the needles by the needle selection device and to reduce the moveable mass of the cam carriage, which carries the cam elements, and a contribution is made to this by combining the knitting systems and the loop transfer systems, originally separate and arranged one behind the other in the cam carriage. Due to these tendencies in development, however, the problem of the increased wear and tear, to which the parts of the machine controlling the needles are subjected because of an increased speed of operation of the modern flat knitting machines, is further increased.

The object providing the basis of the invention therefore, is so to construct the selection device, the cam elements and the needles and needle jacks which cooperate with them, in a flat knitting machine of the kind set out in the introduction that, with the smallest possible outlay on the control elements subject to wear, they are subjected to wear to a lesser extent than hitherto, and thereby to ensure an increased reliability of the flat knitting machine.

The object set forth is achieved in accordance with the invention in that the selection points associated with the combined systems are constructed in each case as double selection points with two selection magnets following directly upon one another, with each of which is associated a selection jackraising cam element with different raising heights and in that the depressor jack is formed as a locking jack, which can be engaged by the associated selection jack, and which has a depressor butt, a longitudinal adjustment butt and a locking ridge, which can be moved under a needle plate of the needle bed and, further, in that the presser cam elements which act on the depressor butt of the locking jack are adjustable in the plane of the cams transverse to the longitudinal direction of the needle bed.

The needles which are not selected for knitting or loop transfer can be locked in an inactive or run-through position by means of the locking jack. In the locking position, the needle jacks of the needles in the run-through position are adjusted together with their control butt out of the operative region of the cam elements. Thus, there is no wear on the needle jacks due to the needles in the inactive position, nor do they cause any wear on the presser cam elements. There is no friction between the depressor butt and the presser cam elements so that the demand on the power from the cam carriage drive of the flat knitting machine is reduced.

By means of the double selection points, the needles can be selectively brought into one of three possible operative positions and the second selection magnet does not act on selection jacks which have already been influenced by the first selection point.

Due to the adjustability of the presser cam elements in the plane of the cams, that is parallel to the plane of the needle bed, the presser cam elements can be set for various control functions according to the position to which they are adjusted, which eliminates at least one additional cam track for the control butt of the needle jack. In addition the number of presser cam elements is reduced. The whole cam construction can be formed more compactly and more favourable leverage conditions for the presser cam elements result, which also improves the reliability of the flat knitting machine. Because of the adjustability of the presser cam elements in the plane of the cams, allotment of the presser cam elements to two parallel tracks extending in the direction of cam carriage movement is sufficient. Advantageously, the presser cam elements can be located on a cam plate element which is moveable together with a lowering cam element of the combined system, in particular by means of a step motor. Further, such a positive coupling of the movement of several cam elements increases the reliability of the flat knitting machine and makes it necessary to have fewer drive elements for the adjustable cam elements.

The danger which exists in known knitting machine needles with articulated needle jacks of the disconnection of the articulation is avoided in the flat knitting machine constructed according to the invention since the force-transmission between needle jack and needle no longer takes place at the sensitive articulation point but at a special coupling point spaced from the articulation point. Advantageously, this coupling point can be formed immediately adjacent the control butt of the needle jack. The special coupling point provides a substantially greater coupling surface than the articulation point of hitherto known similar needles can provide. By arranging the coupling point at the butt of the needle jack, there is achieved, in addition, a stabilisation of the control butt of the needle jack against undesired movement out of the adjustment plane of the needle, due to the frictional engagement of the hook part of the needle with the needle jack.

A further improvement in the reliability of the machine with a simultaneous increase in the control possibilities for the needles can be achieved in that the needles have on the rear side, a slot for the reception of at least one safety cam element, spring mounted on the cam carriage at right angles to the needle bed, and which merges into a wedge-shaped point at each end. By means of this safety cam element, the needles can be maintained in position in the region of the knocking-over bits. Advantageously, this safety cam element, with its wedge-shaped points, can be constructed asymmetrically with respect to the aperture in the cam element and so formed that, when inserted turned through 180° it takes up a different position transversely to the needle bed. Thus, a different adjustment and a correct subsequent control of the needle position to the knocking-over bit height of the needles can be achieved. Further, by means of the safety cam elements, an adjustment of the needles below the knocking-over bit level can be achieved, which is advantageous for stabilising the stitches in certain designs. In addition, a delayed lowering effect can be achieved with these safety cam elements. The correcting movement of the needles is not hindered by the needle jack or by the other jacks associated with the needle. Because of its spring mounting, the safety cam element forms at the same time a needle break detector, which is effective upon lifting of the cam element.

In a flat knitting machine constructed in accordance with the invention, those needles are selected in the needle selection device, which are to knit, tuck, deliver loops or receive loops. By means of a construction of the special coupling point between needle and needle jack wherein a hook part of the needle engages in a correspondingly dimensioned slot in the needle jack, frictional forces are exerted on the needle jack by the needle hook, which tend to maintain the control butt of the needle jack in its active position. Thus, there is no danger that the control butt, due to high cam carriage speed or in accelerating sections of the cam track, will be undesirably released from the cam track.

An embodiment of a knitting machine constructed in accordance with the invention will be described in greater detail below, with reference to the accompanying drawings, which show the parts of the machine essential to the invention, more or less schematically.

Figure 2:
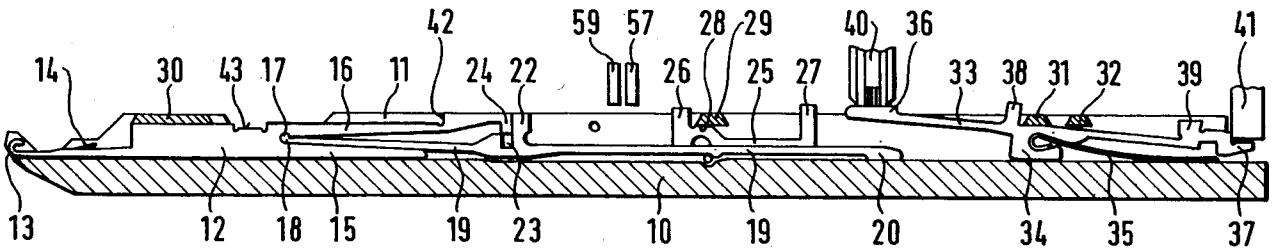
Figure 3:
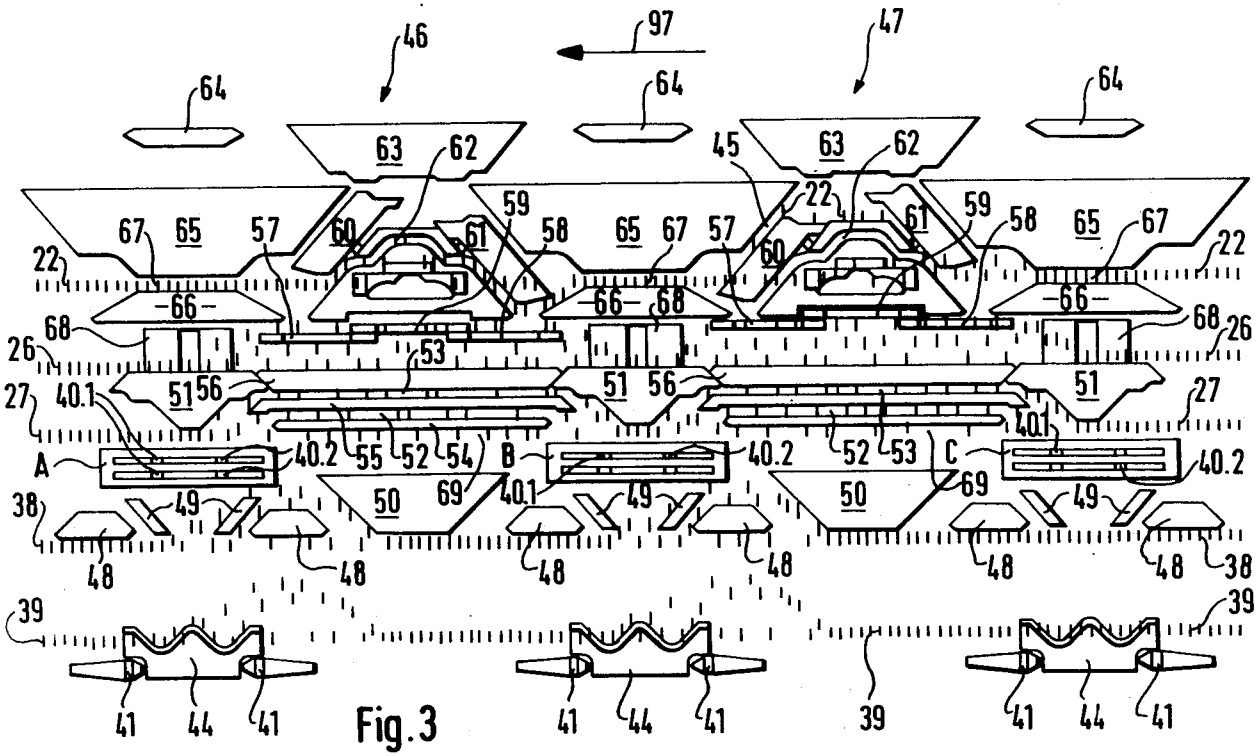
Figure 5:
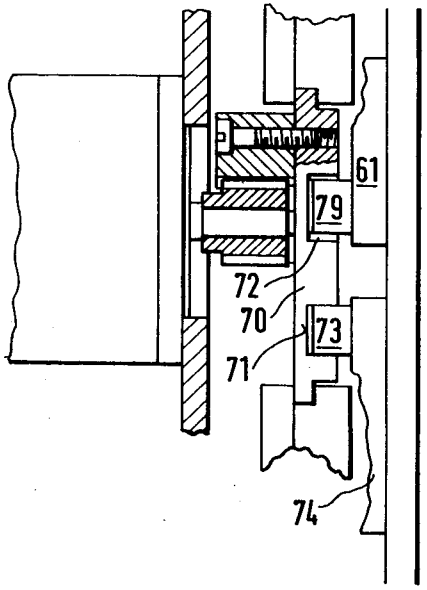
Figure 4:
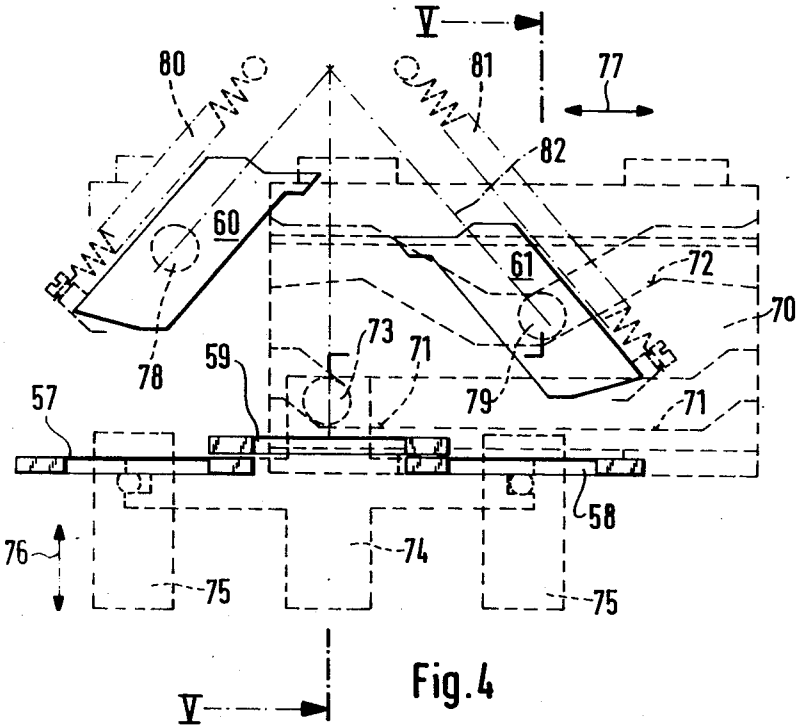
Figure 6:
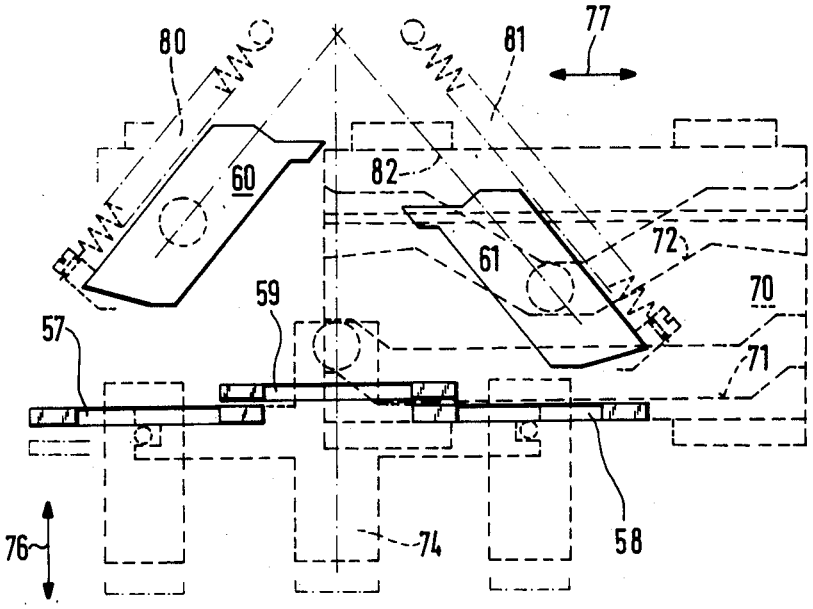
Figure 7:
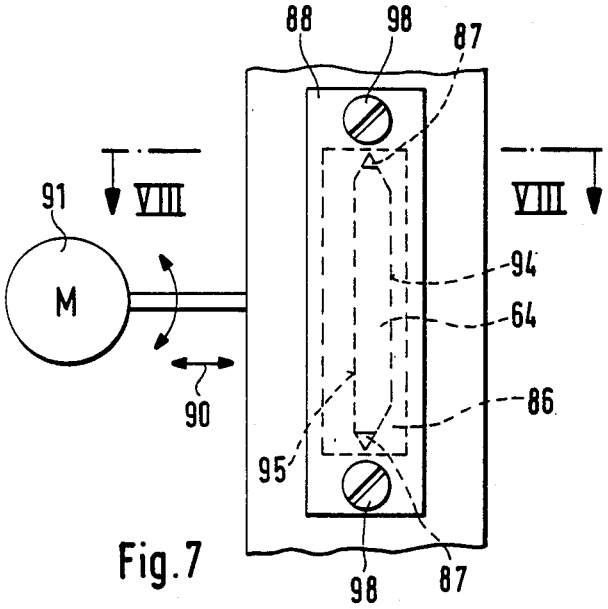
Figure 8:
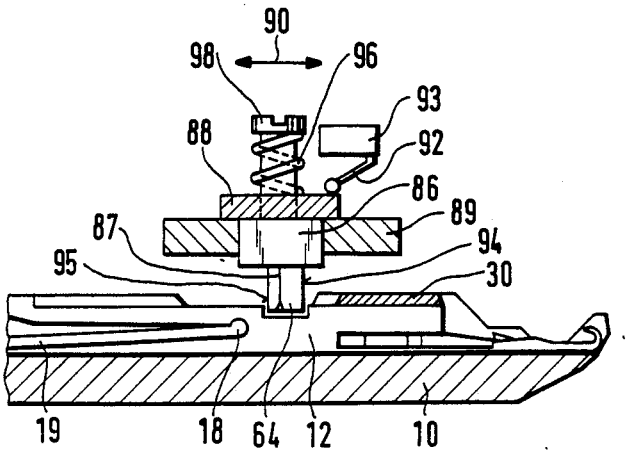

In detail there is shown:

In FIGS. 1 and 2 a schematic cross-section through one of the needle beds along one of the tricks for guiding the needles and needle jacks, for two different operative positions;

In FIG. 3 a schematic plan view on one of the cam plates of the cam carriage with the cam elements for two combined knitting and loop transfer systems, which are associated with one of the two needle beds;

In FIG. 4 a detailed representation of presser cam elements and lowering cam elements of one of the combined systems, which are positively coupled together for adjustment;

In FIG. 5 a cross-section along the line V—V in FIG. 4 showing the positive adjustment mechanisms;

In FIG. 6 a view corresponding to FIG. 4 of another setting of the cam elements which are coupled together for adjustment purposes;

In FIG. 7 a schematic plan view of an adjustable safety cam element of the flat knitting machine;

In FIG. 8 a cross-section along the line VIII—VIII in FIG. 7 through the safety cam element operating on a needle of one of the needle beds.

FIGS. 1 and 2 show a cross-section through one of the two needle carriers of a flat knitting machine, which, in particular, are disposed in so-called V-arrangement with respect to one another, for example, through the front needle bed 10, on which guide tricks for needles and needle jacks are formed, in known manner, between walls 11 arranged spaced from and parallel to one another. In the present embodiment so-called transfer needles 12 are provided as latch needles with a needle head 13 and a needle latch 14. The plate-like shaft of the needle 12 is bifurcated in its rear half and has a supporting web 15 lying on the base of the guide trick and an upper coupling web 16. The point of bifurcation is formed as a coupling position 17 for the coupling head end 18 of a needle jack 19 formed as a spring plate and coupled with the needle 12. The needle jack 19 for the needle 12, formed as a spring plate, is supported with its free end 20 on the base 21 of the guide trick and in its central region has a control butt 22. Directly adjacent the control butt 22 it is provided with a coupling slot 23 in which a correspondingly dimensioned hook part 24 at the end of the coupling web 16 of the needle 12 engages. The hook part 24 of the needle 12 and the coupling slot 23 of the needle jack 19 form the actual force-transmitting coupling position between the needle 12 and the needle jack 19. The needles 12 have at the rear, in a central region, a slot 43 and on the coupling web 16, spaced from the rear hook part 24, a shoulder 42.

On the rear of the spring plate-like needle jack 19 is located a longitudinally slidable locking jack 25 which has at its one end a depressor butt 26 and at its other end a longitudinal adjustment butt 27. Adjacent the depressor butt 26 a locking ridge 28 is formed on the locking jack 25, which, in the position of FIG. 2, is pushed under a needle plate 29 extending in the longitudinal direction of the needle bed 10.

In FIGS. 1 and 2 further needle plates 30, 31, 32 are indicated for safeguarding the needles 12 and for selection jacks 33. The selection jacks 33 are formed in known matter as two-armed pivoted levers, which are pivotable about a support 34 and are pre-tensioned by means of a spring 35 to the position shown in FIG. 1. The end of the one arm of the selection jack 33 is formed as an armature 36 for electro-magnets 40 arranged, in known manner, at the selection points A, B, C (FIG. 3) of the cams, whereas the end 37 of its other arm co-operates with the presser cam elements 41 of the cams arranged at the selection points A, B, C of the needle selection device. The selection jacks are also provided with a first control butt 38 and a second control butt 39 for their longitudinal movement. They can act on the longitudinal adjustment butt 27 of the associated locking jack 25 to effect its longitudinal movement by means of their ends formed as armatures 36.

In FIG. 3 are shown the cam elements of two combined knitting and loop transfer systems 46 and 47, which act on the needles 12, the needle jacks 19, the locking jacks 25 and the selection jacks 33. Both systems 46 and 47 are exactly the same and formed in symmetrical mirror-image fashion, in known manner, for both directions of movement of the cam carriage. The butts of the needle and jacks are shown by short lines. There will be described below, from the bottom towards the top, the cam elements and other control elements arranged on the cam plate which is shown. At the lower edge are shown the presser cam elements 41, which act on the ends 37 of the selection jacks 33 in the region of the needle selection points, and there are indicated the second control butts 39 of the selection jacks 33 which can be influenced by the cam elements 44. Higher up is located a row of raising cam elements 48, 49 and lowering cam elements 50 which act on the butts 38 of the selection jacks 33. Higher up are located, in all, three groups of needle selection points A, B and C, which are formed as double selection points, at which there are located in rows of pole shoes, in each case, two electromagnets 40.1 and 40.2 spaced apart by a short distance one behind the other. The selection jacks 33 depressed by the electromagnets 40.1 are influenced by the longer raising cam element 49 and the selection jacks 33 depressed by the electromagnet 40.2 are influenced by the shorter raising cam element 48 above the cam element 44.

Above the needle selection points A, B and C is located in each case a fixed lowering cam element 51 for the longitudinal adjustment butts 27 for locking the locking jacks 25, and for each lowering cam element 51, presser cam elements 68 acting on the depressor butts 26 of the locking jacks 25 are arranged in series. Between the three lowering cam elements 51 extend parallel cam wall elements 54, 55 and 56, which form the edges of longitudinal guide tracks 69, 52 and 53. If the butts 27 of the locking jack 25 run underneath the cam wall element 54 in the longitudinal guide track 69, the locking jack 25 is located in the locking position to be seen in FIG. 2. If the butts 27 run in the cam track 52, the associated locking jack 25 is freed and its depressor butt 26 is thus not acted upon (in system 46, knitting, and in system 47, transfer). If the butts 27 of the locking jack 25 run in the cam track 53, the depressor butt 26 of the locking jack 25 passes at the system 46 into the region of the presser cam element 59 located in the upper row of the two rows of presser cam elements incorporated in system 46 (tucking, in system 46). The presser cam elements 57–59 are, however, capable of upwards adjustment in the plane of the cam system through a distance of one row, whilst remaining parallel to their original direction, as shown in system 47, and as will be explained in greater detail with reference to FIGS. 4 to 6. This entails that the locking jacks 25, whose butts 27 are located in the cam track 53 at the combined system 47, are influenced through their depressor butts 26 not by the presser cam element 59 but by the presser cam elements 57 and 58 (receiving knitted loops).

Above the two rows of presser cam elements 57–59 are located interengaged cam elements of the combined systems 46 and 47, which act on the control butts 22 of the needle jacks 19 and selectively control the needles to the position for knitting, tucking, delivering a loop, or receiving a loop. The construction and operation of the cam elements of such combined knitting and loop transfer systems is described, for example, in West German patent specification (DE - OS) No. 3537612. For reasons of clarity, there are shown in FIG. 3 only the adjustable lowering cam elements 60 and 61, essential for the invention, the knitting cam track 62, a cam track 45 and a cam element 63 which acts on on the shoulder 42 of the needles 12. At both sides of the cam element 63 of the combined systems 46, 47 are located, in addition, adjustable safety cam elements 64, which will be described in greater detail below in connection with FIGS. 7 and 8. In front of and between the combined systems 46 and 47 the control butts 22 of unlocked needles 12 are guided in a cam track 67. Locked needles 12 are acted on and guided in these regions by the safety cam elements 64.

In the two combined systems 46 and 47, the presser cam elements 57–59, which are adjustable in the plane of the cams, and the lowering cam elements 60 and 61, also adjustable in the plane of the cams, are coupled together by a connecting plate 70 in a manner shown in FIGS. 4 to 6. Two control channels 71 and 72 are formed in the connecting plate 70. A guide pin 73 is engaged in the first control channel 71, and is secured in a supporting plate 74 common to the presser cam elements 57, 58 and 59. The plate 74 is mounted with elements 75 for movement in the direct direction of the double arrow 76 transverse to the direction of movement of the cam carriage and also transverse to the direction of adjustment of the connecting plate 70 shown by the double arrow 77. The adjustment of the connecting plate 70 can be effected by means of an adjustment motor, not shown. The other channel 72 acts on guide pins 78 and 79 located on lowering cam elements 60 and 61, which are urged by tension springs 80, 81 into their end positions. By adjustment of the connecting plate 70 in the direction of the double arrow 77, the respective operative lowering cam element 61, located with its guide pin 79 in the guide track 72, is adjusted in the direction of the line 82 shown chain-dotted in the Figures, to alter the depth by which the needles 12 are lowered and thus the stitch length. During this alteration in the depth by which the needles are lowered, the guide pin 73 of the plate 74, which carries the presser cam elements 57–59 is located in a straight central region of the guide channel 71, so that no adjustment of the plate 74 in the direction of the double arrow 76 results. Only when the connecting plate 70 is shifted fully to one of its end positions does the stud 73 enter a rising end region of the guide channel 71, so that the plate 74 is shifted from the position shown in FIG. 4 into the position shown in FIG. 6. The presser cam elements 57–59 are thereby shifted in each case in a parallel fashion through the width of a track.

FIGS. 7 and 8 show the construction and arrangement of the safety cam elements 64. Each safety cam element 64 is arranged asymmetrically on a rectangular insert 86 and at each end has the form of a wedge-shaped point. The rectangular insert 86 is secured to a wider mounting plate 88. The rectangular insert 86 can be introduced into a matching aperture, having the same cross-section, of a cam plate 89, which is moveable in the direction of the double arrow 90, shown in FIG. 7, in the direction of the guide tricks of the needle bed 10. In FIG. 7 an electric adjustment motor 91 is shown symbolically.

The insert 86 with the safety cam element 64 is mounted in the cam plate 89 for movement at right angles to the needle bed 10 against the action of a return spring 96 on cheese-head screws 98. If the safety cam element 64 is lifted, due to a needle breakage, the feeler 92 of a stop switch 93 is operated and the flat knitting machine is immediately halted.

The insert 86 can be removed from the aperture of the cam plate 89 and re-introduced again turned through 180° in the plane of the cams. Because of the asymmetrical arrangement of the safety cam element 64 on the insert 86, the then effective guide edge 94 of the safety cam element 64 is displaced in the direction of the arrow 90 with respect to, but parallel to the other guide edge of the safety cam element 64.

The mode of operation of the needle selection device is as follows: FIG. 1 shows a needle jack 19 with a control butt 22 in the operative position, when a selection magnet 40.1 has pushed down the magnetic armature 36 of the selection jack 33 at the selection point A, and the cam element 44, which engages the second control butt 39 of the selection jack 33, has pushed the selection jack 33 so far forward, that it enters the operative region of the raising cam element 49 with its first control butt 38. Due to its displacement by the raising cam element 49, the selection jack 33 abuts with its magnetic armature 36 against the longitudinal adjustment butt 27 of the associated locking jack 25 and pushes the locking jack 25 out of its locking position shown in FIG. 2 forward to such an extent that the depressor butt 26 of the locking jack 25 enters the track of the presser cam elements 57, 58 or 59 (according to the position of the connecting plate 70). The longitudinal adjustment butt 27 of the locking jack 25 then runs in the cam track 53. FIG. 1 shows the depressor butt 26 shortly before it engages with the presser cam element 59 of the combined system 49. The control butt 22 of the needle butt 19 thus enters the cam track 62. If it climbs to tuck height therein, the presser cam element 59 becomes operative and releases the control butt 22 from the cam track 62. The needle 12 is thus raised only to tuck height. If the selection magnet 40.2 had been active, the shorter raising cam element 48 would effect a movement of the butt 27 of the locking jack 25 only as far as the cam track 52 and the presser cam elements 57, 58 or 59 would remain inoperative. In this case, the needle 12 gains its knitting position and runs through the entire cam track 62.

FIG. 2 shows the needle jack 19 in a locked position in which its control butt 22 is removed from the cam tracks and remains uncoupled at the height of the cam track 67. This position is thus achieved or maintained if the associated selection jack 33 is not influenced by either of the two selection magnets 40.1, 40.2 at one of the needle selection points A, B or C and thus remains in the position shown in FIG. 2 with a depressed control butt 39. In this case, the first control butt 38 of the selection jack 33 runs through underneath the cam elements 48–50 in FIG. 3, unaffected by these cam elements. The longitudinal adjustment butt 27 of the associated locking jack 25 is retracted by the lowering cam element 51, when the presser cam element 68 acts on the depressor butt 26, to the position shown in FIG. 2, in which the locking ridge 28 of the locking jack 25 is pushed under the needle plate 29.

If an adjustment of the connecting plate 70 to its end position shown in FIG. 6 is brought about, a common adjustment in height of the presser cam elements 57–59 through the width of a presser cam row is effected. Such an adjustment is shown in the combined system 47 in FIG. 3, of course in relation to the lowering cam element 60 which has been lowered to the greatest extent. Thus this system is set up for delivering and receiving loops. The selection jacks 33 depressed by the selection magnet 40.1 at the selection point B and influenced by the raising cam element 48 can then move the locking jack 25 into the sphere of influence of the presser cam elements 57 and 58. The control butt 22 of the associated needle jack 19 is released, is not affected by the lowering cam element 60, and participates in the reception of a loop. The longitudinal adjustment butt 27 of the associated locking jacks 25 runs, in this case, in the cam track 53.

The selection jacks 33, depressed by the second selection magnet 40.2 and influenced by the raising cam element 48, maintain the needle jacks 19 in an unlocked position. Its control butt 22 remains in the operative position and runs upwards at the back of the lowering cam element 60 of the combined system 47, in the needle track 45 which is formed there, whereby the needle 12 is raised to a loop delivery position and impinges with its shoulder 42 against the cam element 63. The longitudinal adjustment butt 27 of the associated locking jack 25 runs, in this case, in the cam track 52.

In front of, between and behind the two combined systems 46 and 47, the uncoupled needles 12 are influenced as to their position by the safety cam elements 64. According to how the control cam elements 64 are set, the control edge 94 or the control edge 95 is operative and the needles 12 are maintained exactly at knocking-over bit height, or a little below, by the safety cam elements 64, which engage in their slot 43. By an adjustment of the position of the safety cam element 64 by means of the adjustment motor 91, however, an even more pronounced post-adjustment of the needle position up to the point of effecting a true post-retraction can be brought about. This movement is not impeded by the jacks which co-operate with the needles. The safety cam elements 64 are raised by broken needles and effect the stoppage of the machine already mentioned.

I claim:

1. A flat knitting machine with a needle selection device, having two needle beds provided with tricks for guiding needles, needle jacks and selection jacks and a cam carriage with combined knitting and loop transfer systems, which have adjustable presser cam elements for a depressor jack associated with each needle, adjustable lowering cam elements, and needle jacks which are articulated with the longitudinally moveable needles and have a control butt, which can be sunk into the needle bed and thus removed from the cam tracks of the cam carriage, characterised in that the selection points (A, B, C) associated with the combined systems (46, 47) are constructed in each case as double selection points with two selection magnets (40.1, 40.2) following directly upon one another, with each of which is associated a selection jack-raising cam element (48, 49) with different raising heights, further characterised in that the depressor jack is formed as a locking jack (25), which can be engaged by the associated selection jack (33) and has a depressor butt (26), a longitudinal adjustment butt (27), and a locking ridge (28), which can be moved under a needle plate (29) of the needle bed (10), and, further characterised in that the presser cam elements (57-59), which act on the depressor butt (26) of the locking jack (25), are adjustable in the plane of the cams transverse to the longitudinal direction of the needle bed.

2. A flat knitting machine according to claim 1, characterised in that the presser cam elements (57-59) for the locking jacks (25) are allotted to two parallel tracks extending in the direction of the cam carriage movement and are adjustable together transverse to the longitudinal direction of the needle bed and the direction of movement of the cam carriage.

3. A flat knitting machine according to claim 2, characterised in that the presser cam elements (57–59) are located on a plate (74), which is moveable together with an adjustable lowering cam element (60, 61) of the combined system (46, 47).

4. A flat knitting machine according to claim 1, characterised in that the locking jack (25) is mounted so as to be longitudinally moveable on the needle jack (19) of the associated needle (12), and in that the needles (12) have a force-transmitting coupling point (23/24) for the corresponding needle jack (19),spaced from their articulation point (17).

5. A flat knitting machine according to claim 4, characterised in that the needle (12) is bifurcated at its inner end and has a supporting web (15) and a coupling web (16), and the bifurcation point is formed as an articulation point (17) for the one end (18) of the needle jack (19), and in that the coupling web (16) of the needle (12) ends in a hook part (24) directed towards the needle bed (10) and which engages in a correspondingly dimensioned slot (23) of the needle jack (19).

6. A flat knitting machine according to claim 5 characterised in that the coupling slot (23) is formed immediately adjacent the control butt (22) of the needle jack (19).

7. A flat knitting machine according to claim 1, characterised in that the longitudinal adjustment butt (27)

of the locking jack (25) is compelled to move into cam tracks (69, 52, 53) in the region of cam elements of the combined systems (46, 47), which act on the control butt (22) of the needle jack (19).

8. A flat knitting machine according to claim 1, characterised in that presser cam elements (68) which act on the depressor butt (26) of the locking jacks (25) are located in series arrangement in the direction of through movement before lowering cam elements (51) for the longitudinal adjustment butt (27) of the locking jack (25), which serve to effect the locking action.

9. A flat knitting machine according to claim 1, characterised in that the needles (12) have, on their rear side, a recess (43) for the reception of at least one safety cam element (64) spring mounted on the cam carriage at right angles to the needle bed (10) and which merges at both ends into a wedge-shaped point (87).

10. A flat knitting machine according to claim 9, characterised in that the spring mounted safety cam elements (64) are connected to a stop switch (92/93).

11. A flat knitting machine according to claim 9, characterised in that the safety cam element (64) and its wedge-shaped points (87) are formed a symmetrically on an insert (86), formed in such a way that the safety cam element (64) when inserted turned through 180° takes up a different position transverse to the needle bed (10).

12. A flat knitting machine according to claim 1 characterised in that the safety cam element (64) is mounted in the cam carriage for adjustment transverse of the needle bed (10) by means of an adjustment motor (91).

13. A flat knitting machine according to claim 1, characterised in that the common adjustment of the presser cam elements (57–59) and the lowering cam elements (60, 61) of the combined systems (46, 47) is achieved in each case by means of an adjustment motor.

14. A flat knitting machine according to claim 1, characterised in that the needles (12) have on the rear side of their coupling web (16) a shoulder (42) spaced from the hook part (24) formed at the end of the coupling web (16) and serving as an abutment position for cam elements (63).

* * * * *